US005899504A

United States Patent [19]

Fabel

[11] Patent Number: 5,899,504

[45] **Date of Patent: * May 4, 1999**

[54] MULTI-PART NON-IMPACT PRINTER AIRBILL FORM

[75] Inventor: Warren M. Fabel, Delray Beach, Fla.

[73] Assignee: Laser Substrates, Inc., Boca Raton, Fla.

[ * ] Notice: This patent is subject to a terminal disclaimer.

[21] Appl. No.: 08/377,126

[22] Filed: Jan. 23, 1995

[51] Int. Cl.[6] ..... B42D 15/00

[52] U.S. Cl. ..... 283/109; 283/79; 283/81; 283/61; 283/62; 462/2; 462/6; 462/25; 462/64; 462/66; 462/901

[58] Field of Search ..... 462/2, 6, 900, 462/901, 25, 64–68, 70; 283/79–81, 61, 62, 109, 116; 229/70, 74, 300

[56] References Cited

U.S. PATENT DOCUMENTS

| | | | |
|---|---|---|---|
| 4,460,676 | 7/1984 | Fabel | 281/2 X |
| 4,461,661 | 7/1984 | Fabel | 229/73 X |
| 4,530,731 | 7/1985 | Bradley | 462/65 X |
| 4,531,993 | 7/1985 | Bradley | 462/65 X |
| 4,682,793 | 7/1987 | Walz | 462/2 |
| 4,925,213 | 5/1990 | Anderson | 462/26 |
| 4,996,184 | 2/1991 | Bevan et al. | 462/25 X |
| 5,055,153 | 10/1991 | Anderson | 462/25 X |
| 5,294,041 | 3/1994 | Whiteside | 462/900 X |
| 5,295,906 | 3/1994 | Skees | 462/2 X |
| 5,330,232 | 7/1994 | Smith | 283/81 |
| 5,334,571 | 8/1994 | Baxter | 462/29 X |
| 5,346,430 | 9/1994 | Baxter | 462/900 X |
| 5,413,532 | 5/1995 | Raby | 462/2 |
| 5,435,600 | 7/1995 | Griffiths et al. | 462/68 X |
| 5,441,796 | 8/1995 | Steidinger et al. | 283/81 X |
| 5,618,064 | 4/1997 | Main | 283/79 X |
| 5,672,104 | 9/1997 | Baxter | 462/901 X |
| 5,755,375 | 5/1998 | Rogers | 462/64 X |

FOREIGN PATENT DOCUMENTS

| | | | |
|---|---|---|---|
| 365192 | 4/1990 | European Pat. Off. | 462/2 |
| 2291866 | 7/1976 | France | 462/2 |
| 406055877 | 3/1994 | Japan | 283/109 |
| 9003277 | 4/1990 | WIPO | 283/109 |

*Primary Examiner*—Frances Han
*Attorney, Agent, or Firm*—Ted W. Whitlock

[57] ABSTRACT

A multi-part, partially pre-printed form useful as an airbill has address information printed thereon by a non-impact printer. The form includes top and bottom transparent plastic sheets affixed together by an adhesive having three panels defined by perforation cuts through the top sheet and die cuts through the bottom sheet. The adhesive facing side of one of the sheets is preprinted with information appearing on each panel. In addition, a background opaque color is printed over the information on two outer panels, leaving the center panel transparent. The information pre-printed on the opaque panels having is in a mirror image format relative to the information pre-printed on the transparent panel. The address is printed on the outward side of the bottom sheet such that the address printed on the transparent panel is a mirror image relative to the information on outer panels. A four part form is also disclosed.

14 Claims, 3 Drawing Sheets

MULTI-PART NON-IMPACT PRINTER AIRBILL FORM

BACKGROUND OF THE INVENTION

1. Field of the Invention

This invention relates to a multi-part address form for use with a non-impact printer, and more particularly, to an airbill form which may be used for addressing packages sent by an overnight mail service.

2. Background Information

Overnight air courier services have become a common mode to send original documents and goods. Examples of such services include the Express Mail service of the United States Postal Service, Federal Express, United Parcel Service, DHL, Airborne, and many others. Most commercial air courier services utilize a similar multi-part airbill form in which as the name of the shipper and the name of the recipient are printed once and appear on all sheets of the airbill form. Typically, current multi-part airbill forms have four sheets, one for the sender, one for the recipient signature as a proof of receipt, one for the package and one for the air courier's billing department. Many of the various multi-part airbill forms used by the various air courier services have a peel away back, which exposes a pressure sensitive adhesive for permitting the airbill form to be affixed to the package being sent.

In order to use these airbill forms, it is necessary to add both the address of the recipient and the return address of the sender on the airbill form and this information must appear on each of the four sheets. Carbon paper or coatings of microcapsules are used to permit the user to add the information only one time on the top sheet and still have it appear on the remaining sheets. Nevertheless, the address information must be added to the airbill form by either, a typewriter, an impact printer, or by hand. Most offices today utilize computers because of their well known advantages over typewriters and manually prepared documents; further, most computer systems in use in offices have attached thereto a non-impact type printer, such as the laser printer or ink jet printer, because of the speed and quiet operation of non-impact printers over the older impact printers, or typewriters.

Because of the non-impact type of printing equipment used in modern offices, the address information added to air courier airbill forms must be done manually, leaving the air courier company with the problem of reading the handwriting of someone else. While manually adding the address information to airbill forms may be efficient where one, or a small number of packages, are to be sent, it is very inefficient where a large number of packages are to be sent. In the latter case, it is desirable to use a computer and associated printer to prepare the airbill forms. For example, where a mail order vendor ships merchandise by overnight air courier, many hundreds or thousands of airbill forms must be prepared daily and manual preparation of the airbill forms is very inefficient. With current airbill forms, the only manner of using a computer is to utilize an impact printer, which is both slow and noisy. Non-impact printers, which are faster and quieter than impact printers, cannot be used because of the requirement to have the address information on each sheet of the existing multi-part airbill forms.

What is needed is an air courier airbill form which can be printed using a non-impact printer.

SUMMARY OF THE INVENTION

In accordance with one aspect of the invention, there is provided a multi-part, partially pre-printed, form for use as an address label on a package, in which address information is printed by a non-impact printer on one side of the form proximate to the time the form is to be used. The form includes a first panel on which certain information and a background color is pre-printed thereon and a transparent panel on which only certain information is printed. The transparent panel is separated from the first panel by means permitting the folding of the first panel over the transparent panel. The address information is printed on the one side of each of the panels such that the address information on the transparent panel is a mirror image to the normally readable address information printed on the first panel. Further, there is included means for affixing the one side of the transparent panel to the package and means for affixing the side of the first panel, opposite to the one side, to one of another portion of the form or the package.

In accordance with another aspect of the invention, there is provided a method of using a pre-printed multi-part form as an address form for a package. The form has a first panel pre-printed with certain information and a background color and a transparent panel pre-printed with only the certain information. One side of the form further has means to affix the transparent panel to the package. The method includes the steps of printing the address information on both the first and transparent panels on the one side of the form, such that the address information printed on the transparent panel is a mirror image of the normally readable address information printed on the first panel. Further, the method includes the steps of affixing the one side of the transparent panel to the package, folding the first panel over the transparent panel, and affixing the first panel to one of another portion of the form or the package.

In accordance with another aspect of the invention, there is provided a method of manufacturing a pre-printed multi-part address form for a package, the form including a pair of transparent sheets. The method includes the steps of printing foreground information and a background color on one of the sheets. The background color is printed only on a portion of the one sheet and the foreground information on that portion being printed in a mirror image format relative to the remaining foreground information. The method further includes the steps of coating an adhesive on one of the sheets and affixing the sheets together so that the adhesive is between the sheets.

BRIEF DESCRIPTION OF THE DRAWINGS

Preferred embodiments of the subject invention are hereafter described with specific reference being made to the following Figures, in which.

DETAILED DESCRIPTION

Figure 1:
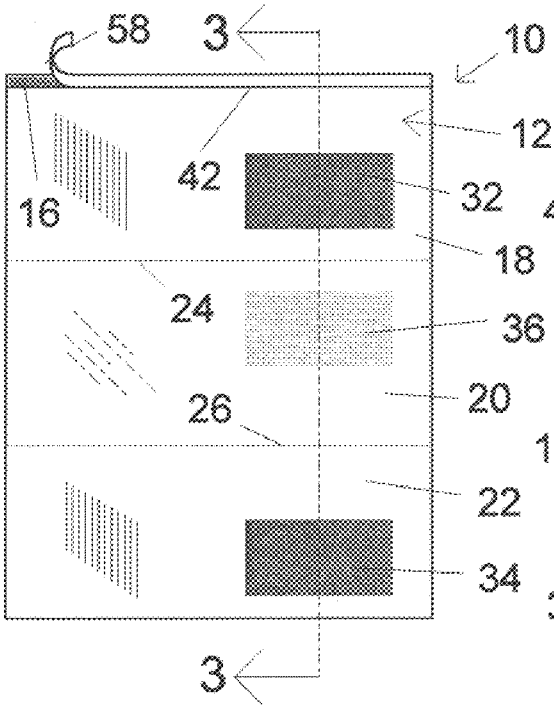
FIG. 1 illustrates a plan views of the front side of a three part airbill form constituting a first preferred embodiment of the subject invention.
Figure 2:
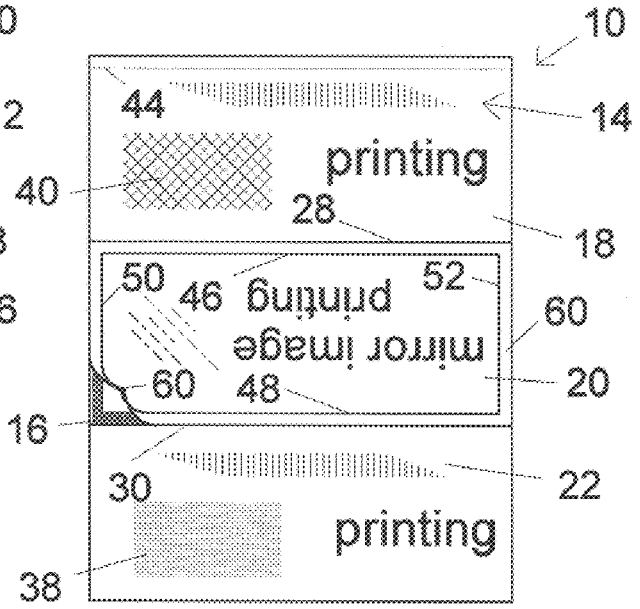
FIG. 2 illustrates a plan views of the back side of the three part airbill form of the subject invention.
Figure 3:
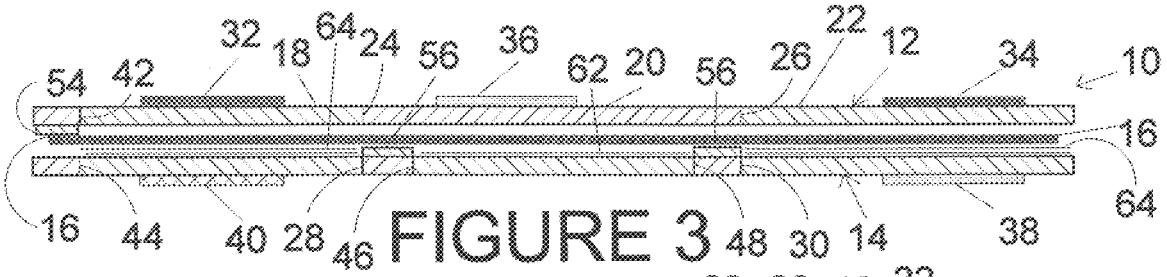
FIG. 3 illustrates a cross-sectional exploded view taken across lines 3—3 of FIG. 1.

Referring to FIGS. 1, 2 and 3, a three part printer airbill form 10 is shown and constitutes a first embodiment of the subject invention. As best seen in FIG. 3, airbill form 10 has two plies, 12 and 14, affixed together by a permanent, pressure sensitive, adhesive 16. FIG. 1 shows the outward facing side of top ply 12 of airbill form 10 and FIG. 2 shows the outward facing side of bottom ply 14. In the first embodiment, airbill form 10 is divided into three panels, top panel 18, middle panel 20 and bottom panel 22, each of which is one of the three parts of airbill form 10. The three panels 18, 20 and 22 may respectively be the proof of delivery receipt, the addressee's receipt and copy for the finance department of the air courier service, which is used for billing purposes. In the three part airbill form 10, there is no sender's receipt, as it is contemplated that computers will be used to generate the address information and the sender's receipt information, such as the airbill number, can be stored in the computer generating the addresses. Where a sender's receipt is desired, a four part form, constituting the second embodiment shown in FIGS. 7, 8 and 9, may be used.

Each of the two plies 12 and 14 may preferably be a transparent polyester film, such as, Melinex 1311, one distributor of which is Plastic Suppliers, 1174 Hayes Industrial Drive, Marrietta, Ga. 35062. Melinex 1311 is a clear film with anti-static properties on both surfaces of its web. Its surface resistivity, independent of gauge, is $2\times10^{10}$ ohms/square, which overcomes the static electricity and laser corona based problems which generally prevent stacks of plastic films from being used with laser printers. Moreover, Melinex 1311 film does not suffer from unacceptable shrinkage, when passed through the high heat of the fusing stage of a laser printer. Melinex 1311 polyester film is described in more detail in U.S. Pat. No. 4,371,489 in the name of Patrick T. McGrall and entitled "Production of Antistatic Thermoplastic Films". Additional problems encouraging the use of Melinex 1311 film are discussed in my co-pending patent application, Ser. No. 08/349,062, filed Dec. 1, 1994 and entitled "Transparent Security Pocket Compatible With Non-impact Printers".

The three panels 18, 20 and 22 on ply 12 are separated by perforated cuts 24 and 26 through ply 12 and the three panels 18, 20 and 22 on ply 14 are separated by die cut lines 28 and 30 through ply 14. These cuts 24, 26, 28 and 30 permit the panels 18 and 22 to be separated after plies 12 and 14 are affixed together by adhesive 16, printed, folded, and applied to a package to be sent, as explained in more detail hereafter.

For airbill form 10 to be most efficiently used with a standard non-impact simplex printer, it is desirable that the printing only occur on one side of airbill form 10. In the first embodiment of airbill form 10, as shown in FIGS. 1–3, the printing by the non-impact printer occurs on the outward facing side of back ply 14 and consists of, at least, the addressee's address. Airbill form 10 is normally pre-printed during manufacture with constant information and instructions so as to appear similar to currently existing air courier airbill forms. For example, lines defining the addressee and return address blocks and instructions may be pre-printed, together with lines for signatures, accounting information, tracing information, and the like. Items, such as the sender's return address, account number and airbill number (in both digital and bar code format) may be either pre-printed or printed by the non-impact printer, depending upon the number of airbill forms ordered from the air courier service by the user/sender.

Certain information, such as internal tracing information, addressee's signature and accounting or billing information, are manually added to airbill form 10 after a package is transmitted by the sender and this information also should appear on all copies of airbill form 10. In order to permit the later added information to be manually added on the top sheet only, coatings of chemically mated imaging materials are placed on the facing sides of plies 12 and 14 to form carbonless copies. As is well known, carbonless copies can occur where layers known as a CF (coated front) coating and a CB (coated back) coating are facing one another. A CF coating is a dry chemical coating on which the information appears and a CB coating is containing microcapsules, each of which, in turn, contain a wet chemical. Where a CF coating and a CB coating are facing one another, adequate pressure will cause the capsules to rupture and a chemical reaction occurs between the dry and wet chemicals, thereby causing an image to appear. Such coatings are well known and commercially available from several vendors.

In three part airbill form 10, CB coatings 32 and 34 are placed on panels 18 and 22 of ply 12, respectively, and CF coatings 36 and 38 are placed on panel 20 of ply 12 and panel 22 of ply 14, respectively. The CB coatings 32 and 34 and CF coatings 36 and 38 are positioned so that when panel 22 is folded along lines 26 and 30 to be over panel 20 and then panel 18 is folded along lines 24 and 28 to be over panel 22, the CB and CF coatings 32, 34, 36 and 38 are aligned with one another and a CF coating 36 and 38 and a CB coating 32 and 34 face one another with the CF coating positioned to receive the image.

Because it is difficult to write on a plastic film, a matte coating 40 is placed on panel 18 of ply 14, which also is aligned with the CF and CB coatings 32, 34, 36 and 38 and is positioned on the outward facing surface of panel 18 after airbill form 10 is folded as explained above. One example of a matte coating which may be used with the airbill form 10 is Craigcoat 1025M, manufactured and sold by Craig Adhesives and Coating Company, of Newark, N.J.

In addition to the perforation cuts 24 and 26 and die cut 28 and 30, a die cut 42 and aligned perforation cut 44 are placed approximately one fourth to one half of an inch below the upper edge of plies 12 and 14, respectively. Further, die cuts 46, 48, 50 and 52 are placed in panel 20 of bottom ply 14, approximately one fourth to one half of an inch away from die cuts 28 and 30 and the outer edges of ply 14.

Referring now to FIG. 3, a exploded cross-sectional view, taken across lines 3—3 of FIG. 1 is shown, where it is seen that top and bottom ply 12 and 14 are held together by adhesive 16. A layer of silicone release material 54 is placed on the interior surface of top ply 12 and in alignment with die cut 42 and perforation cut 44. An additional layer of silicone release material 56 is placed on the interior surface of bottom ply 14 in alignment with and between die cuts 46 and 28, die cuts 48 and 30, die cuts 50 and the edge of ply 14 and die cut 52 and the edge of ply 14. The addition of the silicone material layer 54 permits a strip 58, defined by die cut 42 and the edge of ply 12, to be peeled away, as best seen in FIG. 1. Release product components, manufactured by the GE Silicones division of General Electric Company, U.S.A., yield such a compatible release material. More Specifically, the use of UV9400 solventless UV release polymer, in combination with UV9380C or UV9310C photocatalysts, can be photocured in air, upon irradiation with UV radiation of less than 300 nm wavelength, to provide a silicon release material having a tightly cross-linked epoxysilicone network. GE Silicones 1178-116 Viscosity Modifier can be used to help in forming precise patterns or discrete areas of release coating 24.

Figure 5:
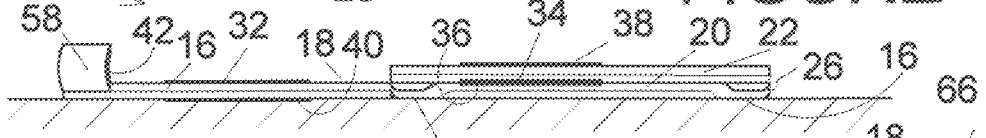
FIG. 5 illustrates an intermediate step in affixing the airbill form of the subject invention to a package.
Figure 6:
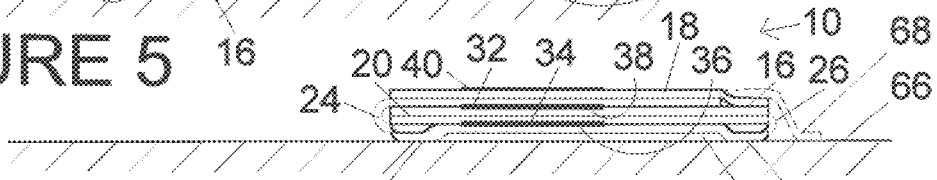
FIG. 6 illustrates the final step in affixing the airbill form of the subject invention to a package.

The addition of the silicon material layer 56 permits a rectangular strip 60, defined by die cut die cuts 46 and 28, die cuts 48 and 30, die cut 50 and the edge of ply 14 and die cut 52 and the edge of ply 14, to be peeled away, as best seen in FIG. 2. When strip 58 and rectangular strip 60 are peeled away, adhesive 16 is exposed. The exposed adhesive 16 below rectangular strip 60 is used to affix the folded airbill form 10 to a package, as seen in FIGS. 5 and 6, and the exposed adhesive below strip 58 is used to affix airbill form 10 together as a folded three part airbill form, as seen in FIG. 6. As seen with respect to strips 58 and 60, adhesive 16 is coated to be slightly remote from the edge of airbill form 10, to prevent bleeding of the adhesive material prior to and during the use of airbill form 10.

Adhesive 16 should be a transparent adhesive and should have a good affinity to both plies 12 and 14, as well as having the ability to affix airbill form 10 to a package, which typically is a paper or cardboard material. One commercially available adhesive which has been found to be acceptable is a compounded synthetic polymer, such as Craigcoat 1051G, manufactured by Craig Adhesives and Coatings Company, of Newark N.J.

As noted above, airbill form 10 is pre-printed during manufacture to closely resemble existing air courier airbill forms. This requires printing both a background color, such as white, and the information, which may be printed in various colors. For example, a U.S. Postal Service Express Mail airbill form has orange and blue borders and printing and a white background on all parts. On some sheets, black printing used to identify the airbill number in both readable format and bar code format is also present. Similarly, a Federal Express airbill form has blue, orange, yellow and black printing with a white background on two sheets, light blue and yellow printing with a white background on a third sheet and blue and orange printing with a pink background on a fourth sheet, used as the customer's receipt.

The pre-printing, as shown in FIG. 3, is preferably placed on the interior facing side of ply 14, and is done in two separate steps. First, the foreground information, represented by line 62, is printed over all three panels 18, 20 and 22. Foreground information 62 is printed in a standard readable format (when looking directly thereat) on panel 20 and in a mirror image and opposite direction format on panels 18 and 22. Next, the background color printing 64 is printed only over panels 18 and 22, leaving panel 20 with a transparent background. As noted above, different background colors 64 may be printed on panels 18 and 22 where different color panels, or parts, of airbill form 10 are desired. By pre-printing the background color (or colors) 64 only on panels 18 and 22, middle panel 20 is transparent and top and bottom panels 18 and 22 appear as a conventional opaque air courier airbill. Alternatively, only the background color 64 may be pre-printed on the interior facing side of ply 14 and all of the information 62 may be printed by the non-impact printer at the time airbill form 10 is being used.

It should be noted that the silicone layers 54 and 56 are added after the foreground and background printing 62 and 64 occurs, so that information can be printed and viewed on strips 58 and 60. It further should be noted that instructions or other information may be pre-printed on the outward facing side of panels 18 and 22 of ply 12.

After airbill form 10 is manufactured, as described above, it is a flat sheet of conventional standard size, such as 8½ by 11 or A4, and is ready for use by a user. The user generated information to be printed includes both the addressee information and any other information desired by the user, such as return address (if not pre-printed), customer numbers, shipping or delivery information or instructions, billing or fee information, airbill number, and the like. The user generated information should be printed on the outward facing side of ply 14, so that it is remote from CB coatings 32 and 34, which can be damaged by the heat in a some types of non-impact printers, such as a laser printer. The format of the user generated printed information is shown in FIG. 2, where it is seen that the printing on opaque panels 18 and 22 is conventional and readable and the printing on transparent panel 20 is in a mirror image format and in the reverse direction relative to the printing on opaque panels 18 and 22. This is opposite to the pre-printed format. Care should be taken to assure that the direction of the printing, both pre-printed and user generated, is in the same direction so that the information is printed in the correct blocks. Thus, an arrow indicating feed direction may be a part of the pre-printed information on one of the panels 18 or 22.

A computer program may be used to generate the user information and format to be printed and to send that information to the non-impact printer in a known manner. Such a program forms no part of this invention and is well within the state of the art.

Figure 4:
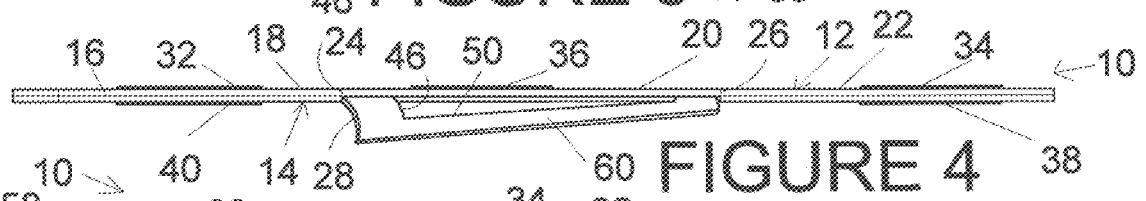
FIG. 4 illustrates the first step in affixing the airbill form of the subject invention to a package.

Referring now to FIGS. 4–6, the manner of affixing airbill form 10 to a package 66 will be described. After the user generated information is printed, rectangular strip 60 is removed, as seen in FIG. 4, thereby exposing the adhesive 16 thereunder. Airbill form 10 is then placed on package 66 so that it becomes affixed thereto by applying a slight pressure above exposed adhesive 16. Next, the ply 14 side of middle panel 20 is affixed to package 66, by applying a slight pressure above the exposed adhesive 16 at rectangular strip 60. At this point, the package 66 forms the background color for transparent middle panel 20, thereby permitting both the pre-printed and user generated printing thereon to be easily readable. As previously noted, the pre-printed information on the interior side of panel 20 on ply 14 is printed in a directly readable format on the interior facing side of ply 14 at panel 20 and the user generated printing on the outward facing side of ply 14 at panel 20 is printed in a reverse mirror image format. Thus, a person can easily read all of the information through transparent panel 20 when it is affixed to package 66.

After airbill form 10 is affixed to package 66, panel 22 is folded about perforation line 26 to the position shown in FIG. 5. Then, strip 58 is removed and panel 18 is folded about perforation line 24 to the position shown in FIG. 6. At that point, the adhesive 16 exposed by the removal of strip 58 is affixed to panel 22 by applying a slight pressure. This completes the affixation of airbill form 10 to package 66. While panel 18 is shown as affixed to panel 22, the dimensions and positioning of panels 18, 20 and 22 may be arranged so that the exposed adhesive 16 below strip 58 is affixed directly to package 66, as seen by the dashed lines 68 in FIG. 6.

As seen in FIG. 6, each of the CB layers 32 and 34, the CF layers 36 and 38 and the matte layer 40 are in alignment after folding and affixation of airbill form 10 to package 66. Further, a CB layer 32, 34 and a CF layer 36, 38 are facing one another between panels 20 and 22 and between panels 22 and 18. Thus, when information is manually added to airbill form 10 by either personal of the air courier service or by the addressee signing the proof of delivery receipt, that information is added over matte layer 40 and appears on the CF layers 36 and 38 on panels 20 and 22.

During transit of package 16, the three parts of airbill form 10 may be separated by manual separation along perforation lines 24 and 26 and panels 18 and 22 of airbill form 10 may be sent as desired by the delivery person, leaving the affixed panel 20 as the addressee's receipt.

Figure 7:
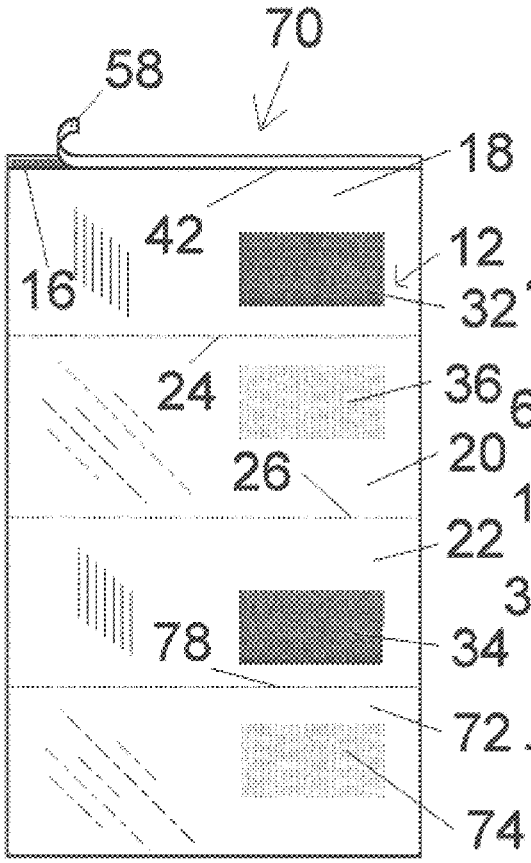
FIG. 7 illustrates a plan view of the front side of a four part airbill form constituting a second preferred embodiment of the subject invention.
Figure 8:
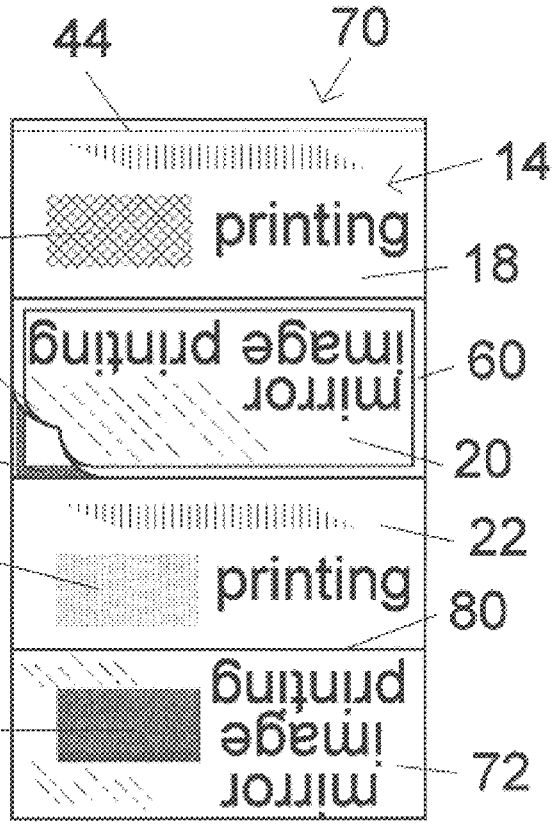
FIG. 8 illustrates a plan view of the back side of the four part airbill form.
Figure 9:
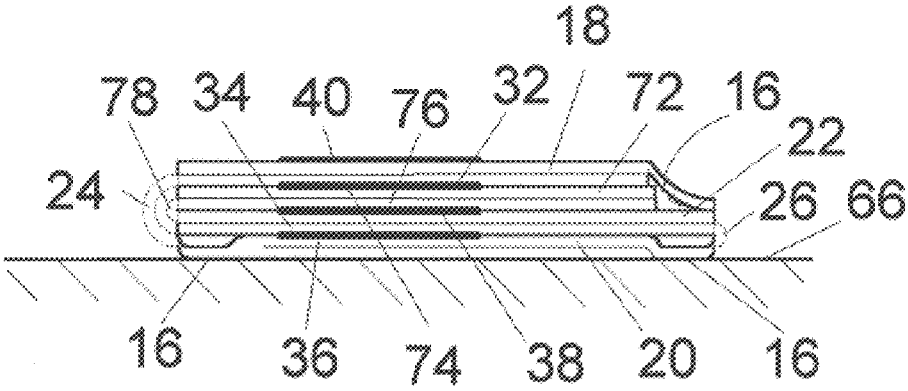
FIG. 9 illustrates the four part airbill form affixed to a package.

Referring now to FIGS. 7–9, a four part airbill form 70 is shown. Airbill form 70 is generally similar to airbill 10, shown in and described with respect to FIGS. 1–6, except that a fourth panel 72 is added below panel 22. In FIGS. 7–9, like numerical designations are given for identical components previously described. The outward facing side of panel 72 on ply 12 has a CF coating layer 74 applied thereto and the outward facing side of panel 72 on ply 14 has a CB coating layer 76 applied thereto. Further, the length of panel 72 is slightly shorter than the other panels 18, 20 and 22, so that a standard 8½ by 14 inch sheet may be used for airbill form 70. On ply 12, panel 72 is separated by a perforation cut 78 from panel 22 and on ply 14, panel 72 is separated from panel 22 by a die cut 80. The printing on panel 72 is similar to that described above for panel 20.

In using airbill form 70, first rectangular strip 60 is removed and airbill form 70 is affixed to package 66 as described above with respect to airbill form 10. Next, panel 72 is folded about perforation cut 72 so that the panel 72 of ply 14 faces panel 22 of ply 14. Thereafter, the assembly of airbill form 70 is generally the same as with airbill form 10, in that panels 72 and 22 are folded along perforation cut 26, strip 58 is removed, panel 18 is then folded along perforation cut 24 and the exposed adhesive 16 from the removal of strip 58 is used to affix panel 18 to panel 22. The reason that panel 18 is affixed to panel 22 is that panel 72 is slightly shorter than the other panels 18, 20 and 22. Alternatively, the exposed adhesive 16 on panel 18 may be affixed to package 66, as seen by the dashed lines 68 in FIG. 6.

While the subject invention has been described with two preferred embodiments, many variations are possible within the scope and spirit of the invention. For example, any number of panels may be designed by either adding additional panels to those shown and described or by removing panels from the three panel embodiment of form 10. Further, the pre-printed matter may be on the outward facing side of ply 14, in which case the pre-printed information will be over printed by the non-impact printer; in this case, the pre-printing on panel 20 and 72 will be the mirror image format. In this case, the pre-printed background color will be printed first and then the pre-printed information will then be printed over the background color. In addition, the background color and pre-printed information may be printed on different plies 12 and 14; for example, the background color 64 may be printed on the interior facing side of ply 12 and the pre-printed information 62 may be printed on the interior facing side of ply 14.

Another alternative is to use a low tack, pressure sensitive, adhesive coating in alignment with strip 58 in place of high tack adhesive 16. One such low tack adhesive is Craig-Stik 3991PI, manufactured and sold by Craig Adhesives and Coating Company, of Newark, N.J. Low tack adhesives are commonly used with self stick note pads, where a sheet of paper can be easily removed without tearing from the pad and affixed to another object. By using the low tack adhesive, it is unnecessary to include the silicone layers 54; in addition, perforation 44 may be eliminated, since the end of panel 18 can be easily removed from affixation to panel 22. It should be noted that permanent adhesive 16 is still used in areas other than in alignment with strip 58.

What is claimed is:

1. A multi-part, partially pre-printed, form for use as an address label on a package, in which address information is printed by a non-impact printer on one side of said form proximate to the time said form is to be used, said form comprising:

a first panel on which information is printed so as to be viewed against an opaque background; and a transparent panel positioned adjacent to said first panel wherein information is printed on said transparent panel over a transparent background, said transparent panel being interconnected to and adapted to be folded over said first panel;

address information being printed on said one side of said form to form a printed side and a back side for each of said panels such that said address information on said transparent panel is a mirror image to the normally readable address information printed on said first panel;

means for affixing said printed side of said transparent panel to said package; and means for affixing the back side of said first panel to one of another portion of said form or said package.

2. The form according to claim 1 wherein said form is formed by first and second transparent sheets superimposably affixed together by an adhesive therebetween.

3. The form according to claim 2 wherein said panels are defined by a die cut on one of said sheets and a perforation cut on the other of said sheets, said perforation cut being aligned with said die cut.

4. The form according to claim 3 wherein said means for affixing said one side of said transparent panel to said package includes at least one additional die cut through said one sheet in said transparent panel, said die cuts forming a pattern on said one sheet in said transparent panel, said form further having a layer of release material between said pattern of die cuts and said adhesive, so that said pattern is removable to expose said adhesive.

5. The form according to claim 2 in which preprinted information is printed on the adhesive facing side of one of said sheets and a background color is printed between said preprinted information and the adhesive facing side of said other of said sheets, said background color being printed only on said first panel.

6. The form according to claim 5 wherein pre-printed information on said first panel is in a mirror image format relative to the pre-printed information printed on said transparent panel.

7. The form according to claim 2 further including a third panel on which said certain information and a background color is pre-printed thereon, said transparent panel being between said first and third panels, said address information further being printed on said third panel in the same format as said address information is printed on said first panel.

8. The form according to claim 2 further including layers of chemically mated imaging coatings selectively placed on said sheets.

9. The form according to claim 2 further including third and fourth panels on which said information is printed, said background color being pre-printed only on said third panel, said transparent panel being between said first and third panels and said fourth panel being an additional transparent panel, said address information further being printed on said third panel in the same format as said address information is printed on said first panel and said address information printed on said fourth transparent panel as a mirror image to the information printed on said third panel.

10. A multi-part, partially pre-printed, form for use as an airbill on a package, in which address information is printed by a non-impact printer on one side of said form proximate to the time said form is to be used, said form comprising:

top and bottom sheets of a transparent polyester film material of a type which accepts printing;

adhesive means between said top and bottom sheets affixing said top and bottom sheets together;

a pair of parallel perforation cuts on said top sheet; a pair of parallel die cuts through said bottom sheet aligned with said pair of perforation cuts;

said perforation cuts and die cuts defining first, second and third panels, said second panel separating said first and third panels;

a plurality of die cuts through said bottom sheet on said second panel, said plurality of die cuts defining a pattern;

an additional die cut through said top sheet on said first panel, parallel to said perforation cuts, defining a strip along an edge of said form;

a first layer of release material aligned with said pattern defined by said die cuts and between said bottom sheet and said adhesive;

a second layer of release material between said top sheet and said strip;

informational printing for each panel on the adhesive facing surface of one of said sheets, said informational printing on said second panel being the mirror image of the informational printing on said first and third panels;

background printing for said first and third panels on the adhesive facing surface of one of said sheets;

a series of chemically mated imaging material layers on outward facing surfaces of said first and second sheets positioned to be aligned with one another when said third panel is folded over said second panel and said first panel is folded over said folded third panel, said chemically mated imaging material layers being selected to permit information manually placed on said bottom sheet of said folded first panel to appear on said second and third panels; and a layer of material adapted for receiving manual writing on said bottom sheet of said first panel, said writing receiving material being positioned to be aligned with said chemically mated imaging material layers when said third panel is folded over said second panel and said first panel is folded over said folded third panel.

11. The airbill form according to claim 10 wherein address information is printed by said non-impact printer on the outward facing surface of said second sheet.

12. The airbill form according to claim 11 wherein said address information is printed on each of said three panels, said printing on said second panel being a mirror image of the printing on said first and third panels.

13. The airbill form according to claim 12, wherein the informational printing on said adhesive facing surface of said one of said sheets for said first and third panels is oppositely directed relative to the informational printing on said adhesive facing surface of said one of said sheets for said second panel, and wherein the address information printed on the outward facing side of said second sheet for said first and third panels is oppositely directed relative to the address printing printed on the outward facing side of said second sheet for said second panel.

14. The airbill form according to claim 13 wherein the format of the informational printing and the address information is a mirror image relative to one another.

* * * * *